US005405215A

United States Patent [19]

Lutz

[11] Patent Number: 5,405,215

[45] Date of Patent: Apr. 11, 1995

[54] PAVING APPARATUS

[75] Inventor: Dieter Lutz, Rheinsheim, Germany

[73] Assignee: ABG-Werke GmbH, Hameln, Germany

[21] Appl. No.: 89,770

[22] Filed: Jul. 9, 1993

[30] Foreign Application Priority Data

Jul. 14, 1992 [DE] Germany ..... 9209426 U

[51] Int. Cl.[6] ..... E01C 19/00

[52] U.S. Cl. ..... 404/84.1; 404/84.2; 298/18

[58] Field of Search ..... 404/75, 84.2, 101, 104, 404/108, 109, 110, 127, 84.1; 366/9, 41, 42, 45, 53, 189; 298/18

[56] References Cited

U.S. PATENT DOCUMENTS 3,130,654 4/1964 Apel et al. ..... 404/104
3,240,164 3/1966 Flowers ..... 298/18
3,636,831 1/1972 Davin et al. ..... 404/84.2
3,636,832 1/1972 Schrimper et al. ..... 404/84.2

*Primary Examiner*—Ramon S. Britts
*Assistant Examiner*—Pamela A. O'Connor
*Attorney, Agent, or Firm*—Chilton, Alix & Van Kirk

[57] ABSTRACT

A mobile paving machine which may, with minor modification, be employed either to distribute material along the path of movement of the machine or in a region which is laterally offset to one side of the motion path. In order to spread material in a laterally offset region, which may correspond to a break-down lane being formed along the side of a travel lane, a tiltable secondary skip is installed above the primary skip to which paving material is normally supplied. A scraper is mounted from an extension of the distribution beam of the machine to controllably disperse material discharged through an end of the secondary skip when the loaded secondary skip is angularly inclined to cause gravity induced flow of material into the lateral region.

20 Claims, 1 Drawing Sheet

PAVING APPARATUS

BACKGROUND OF THE INVENTION

1. Field of the Invention

The present invention relates to the spreading of fill or paving material in a desired region and particularly to the controlled application, in a travel lane or a verge area of a highway right-of-way, of a finishing material. More specifically, this invention is directed to road construction apparatus and especially to a "paving" machine which may selectively be employed for application of material to a travel lane or delivery and distribution of material to a trench or shoulder region which is laterally offset from a travel lane. Accordingly, the general objects of the present invention are to provide novel and improved methods and apparatus of such character.

2. Description of the Prior Art

Road construction methods and apparatus are well known in the art. The equipment employed in highway construction includes devices which may be generally described as paving machines. A typical prior art paving machine will have a chassis which supports a skip at its front end. The skip, to which the material to be applied over the road bed is supplied, is conventionally provided with pivotal side-wall sections which define a filling funnel therefor. Such a paving machine also supports, at the rear of the chassis for working the applied materials, a device known in the trade as a "beam". The skip will have a discharge opening at the bottom and a conveyor moves material which is dumped into the skip, and subsequently flows out the bottom thereof, from the front to the rear of the paving machine. This material will be distributed over the length of the beam by a "distributing worm". The beam of prior art paving machines is typically comprised of a primary beam and a pair of oppositely disposed, adjustable beam extensions so that the material being deposited on the road bed can be spread across the appropriate area. The distance the opposed beam extensions project from the main beam will usually be separately controllable via hydraulic actuators to selectively control the lane width. The beam may also have stamping and/or vibration units which ensure proper distribution of the material supplied via the distributing worm.

The prior art paving machines are usually tracked vehicles. During road construction or repair, trenches are often excavated alongside the outermost travel lanes. During finishing of the road, it may be necessary to close such trenches and/or to form a shoulder area or breakdown lane. In order to employ a prior art paving machine to fill a trench or lay down material for a shoulder region, the tracked vehicle previously had to be positioned so as to straddle the trench or shoulder region. In many cases either the terrain is unsuitable for operating the paving machine with the trench or shoulder region located between the tracks or there is insufficient space available for operation of the paving machine with a trench or shoulder region straddled thereby.

SUMMARY OF THE INVENTION

The present invention overcomes the above-briefly discussed and other deficiencies and disadvantages of the prior art and, in so doing, provides a method of and apparatus for the selective delivery of paving or fill material to a travel lane of a roadway or to a peripheral region located to the side of the travel lane through the use of the same basic apparatus. Accordingly, the present invention permits the closing of trenches located at the side of a roadway or the installation of breakdown lanes without the need for having the paving machine straddle the trench or breakdown lane region.

In apparatus in accordance with the invention, the primary skip of a paving machine is constructed so as to be partially or totally removable and the paving machine is provided with a secondary skip. The secondary skip is closed on the bottom and can be angularly inclined from a travel lane, where the paving machine is positioned, toward a region to the side thereof to which material is to be delivered. The secondary skip is provided with a discharge opening in at least a first end, the discharge opening having a cover which may be opened, and the tilting of the secondary skip will result in gravity induced flow of material therefrom. Apparatus in accordance with the invention also comprises a scraper mechanism which is located, in the direction of paving machine motion, in front of an extension of the beam. In the disclosed embodiment, the scraper is supported from the beam extension.

BRIEF DESCRIPTION OF THE DRAWINGS

The present invention may be better understood and its numerous objects and advantages will become apparent to those skilled in the art by reference to the accompanying drawing wherein like reference numerals refer to like elements in the two figures and in which.

DESCRIPTION OF THE DISCLOSED EMBODIMENT

Figure 1:
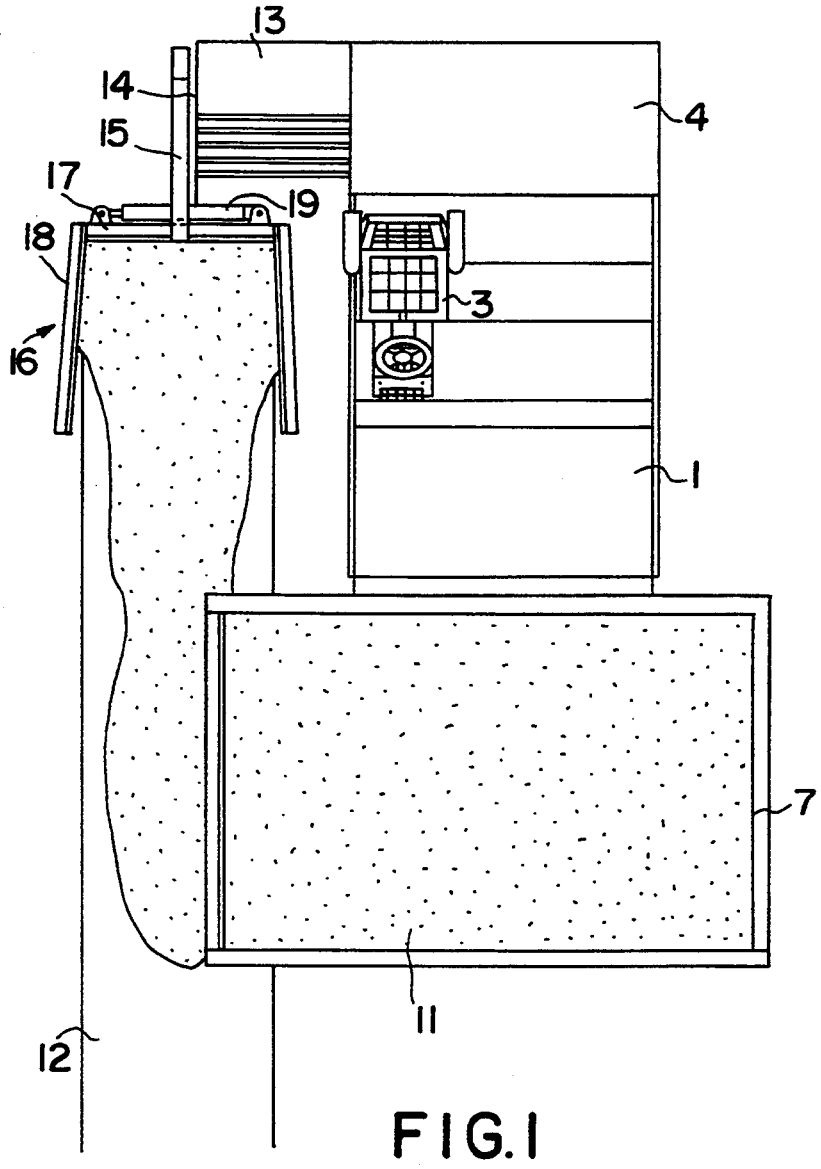
FIG. 1 is a top view of a paving machine in accordance with an embodiment of the invention, the machine of FIG. 1 being depicted in the process of forming a shoulder or breakdown lane.
Figure 2:
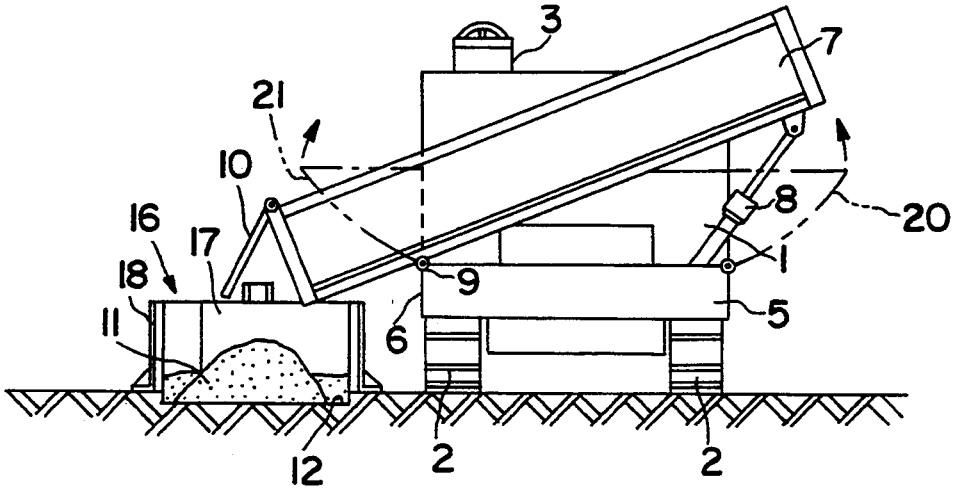
FIG. 2 is a front view of the paving machine of FIG. 1.

With reference to the drawing, a paving machine 1 is in the form of a tracked-type vehicle, the tracks being indicated at 2. The machine 1 is operated from a driver's stand 3 and, during operation, will move from the top of the page toward the bottom of the page as the machine is depicted in FIG. 1. The machine is provided with a primary skip 5 to which paving material is delivered in the conventional manner by a succession of dump trucks by means of raising and tilting the truck beds. During normal operation, i.e., when paving a travel lane, the material delivered to skip 5 will flow out of the open skip bottom and will be conveyed, via a conveyor not shown, from the skip to the vicinity of a beam. The beam, indicated at 4 and 13, is located at the opposite end of the chassis of vehicle 1 with respect to skip 5 and is adjustable in width. The conveyor thus passes beneath the driver's stand 3. The paving or other material being laid down on the road bed is evenly distributed over the selected width of the beam 4 by means of a distributing worm which is of conventional design and thus has not been shown.

The primary skip 5 will normally be provided with side-wall portions 20, 21 which, under the control of hydraulic actuators, are movable relative to fixed side-wall portions 6 of the skip. In order to efficiently function as a feed hopper, these movable side wall portions 20, 21 of the primary skip are relatively high. In accordance with the disclosed embodiment of the present invention, the movable side-wall portions 20, 21 of skip 5 are removed when it is desired to employ the paving machine to close a trench or to lay down material which will form a shoulder or breakdown lane.

A secondary skip 7 is configured for installation above skip 5. The secondary skip 7 is closed on the bottom and is mounted so as to be capable of being tipped to one side. In the disclosed embodiment, the tipping is to the right side of the paving machine when viewed from the rear. The tipping is accomplished by raising the left side of secondary skip 7 by means of a hydraulic actuator 8. For this purpose, the first end of actuator 8 is articulated to the secondary skip 7 adjacent the left end thereof. The second end of the hydraulic actuator 8 will be connected to skip 5 at any suitable point such as, for example, to the left hand fixed side-wall portion 6. The secondary skip 7 of the disclosed embodiment is coupled to the right hand fixed sidewall portion 6 of skip 5 by means of hinges 9. The secondary skip 7 is thus supported by primary skip 5 and pivots about the upper edge of a fixed side-wall 6 of the primary skip 5 during tipping. The right end of skip 7 defines a discharge opening and includes a pivotally supported and lockable cover 10. The cover 10, when in the unlocked condition, will open when the secondary skip 7 is tipped so that material 11 which has previously been deposited in skip 7, this material typically comprising soil, gravel or the like, will flow under the influence of gravity into a trench or shoulder region 12 which is laterally offset to the side of the roadway on which the paving machine is traveling.

The beam of the paving machine 1 comprises a main beam 4 and an extension beam 13 which may be projected outwardly to the right of the main beam 4. The machine 1 will also have an oppositely disposed left extension beam which has not been shown. The extension beams 13 are known in the art and are customarily utilized to adjust the laying width of the paving machine. It is typical for the distance the extension beams project from main beam 4 to be independently controllable by the operator and for the vertical position of the beam assembly 4, 13 to also be operator controllable.

The outwardly disposed end of extension beam 13 is provided with a side wall or cheek 14. The cheek 14 is connected to a scraper, which has been indicated generally at 16, by means of a forwardly directed support arm 15. The scraper 16 is thus affixed to the paving machine and, in part, located in front of extension beam 13. The position of arm 15, and thus of the scraper 16, is vertically adjustable. This adjustment may be accomplished by raising or lowering the beam assembly 4, 13 or by making the connection between arm 15 and cheek 14 adjustable.

The scraper 16 comprises a rear wall 17 and a pair of oppositely disposed side walls 18. The rear wall 17 of scraper 16 is of telescoping construction and its width may be adjusted by means of a hydraulic actuator 19. Material delivered to the region 12 via the secondary skip 7 is distributed in a strip of the required width by the scraper 16, the material being directed into the scraper by means of the convergent side walls 18 thereof, and scraped to the required height. The projection of extension beam 13 from main beam 4 is controlled to insure that the scraper 16 is aproximately centered over the region 12 where the material 11 is to be spread.

The secondary skip 7 of the disclosed embodiment extends outwardly beyond the opposite sides of the chassis of paving machine 1. On the material delivery side, the length of the skip extension will insure that, taking the useable angles of inclination into account, the maximum depth of the deposited material 11 will be along a line which is parallel to the path of machine movement and passes through the obtainable mid-point of scraper 16. To ensure that the paving machine will be in a balanced condition, i.e., to ensure symetrical loading of the paving machine, the extension of skip 7 beyond the opposite side of the chassis will expediently be substantially equal to the extension beyond the material delivery side.

The hydraulic fluid for causing operation of actuator 19, which controls the working width of scaper 16, may be derived from the pressurized source normally used for adjustment of the beam extension which is not in use, i.e., in the disclosed embodiment the actuator 19 may be coupled to the pressurized fluid source for the immobilized beam extension located at the left side of main beam 4. The pressurized fluid for operating the actuator 8, which controls the tilting of the secondary skip 7, may be derived from the source normally employed to position the hinged side-wall portions of the skip 5.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In a paving machine, the paving machine being movable along a path and having a chassis which supports a primary skip at a first end thereof and a main beam at a second end thereof, the paving machine chassis second end being oppositely disposed with respect to the first end, the paving machine also including means for conveying material from the primary skip to the main beam, the main beam having at least a first beam extension which is adjustable in length in a direction generally transverse to the path of motion of the machine, the improvement comprising:

the primary skip being at least in part removable from the chassis;

a secondary skip, said secondary skip being closed on its bottom and having a discharge opening in at least one end, said discharge opening being selectively closed by a cover;

means supporting said secondary skip from said chassis, said secondary skip supporting means permitting said secondary skip to be angularly inclined to place said one end thereof at a lower level than the oppositely disposed end of said secondary skip whereby material carried in said secondary skip may flow through said discharge opening under the influence of gravity and be directed to a region laterally offset from and generally parallel to the path of machine movement;

means for controlling the angle of inclination of said secondary skip;

scraper means for engaging and controllably disbursing material delivered to said laterally offset region via said secondary skip one end; and means for supporting said scraper means from the first beam extension whereby said scraper means will be positioned in front of the first beam extension in the direction of paving machine travel.

2. The apparatus of claim 1 wherein said scraper means includes:

a pair of oppositely disposed side walls;

a telescopic rear wall which extends between said side walls; and actuator means for controllably adjusting the width of said scraper means rear wall.

3. The apparatus of claim 2 wherein the paving machine includes a second beam extension which is located at an opposite end of the main beam from the first beam extension, the length of said beam extensions being separately controllable by fluidic actuators, the second of the beam extensions being immobilized during use of said secondary skip, and wherein said actuator means of said scraper means comprises:

a further fluidic actuator, said further fluidic actuator being coupled to and deriving operating power from the actuator of the immobilized second beam extension.

4. The apparatus of claim 1 wherein said means for controlling the angle of inclination of said secondary skip comprises a hydraulic actuator.

5. The apparatus of claim 2 wherein said means for controlling the angle of inclination of said secondary skip comprises a hydraulic actuator.

6. The apparatus of claim 3 wherein said means for controlling the angle of inclination of said secondary skip comprises a hydraulic actuator.

7. The apparatus of claim 1 wherein the primary skip includes fixed side wall portions and wherein said means supporting said secondary skip comprises:

means for pivotally coupling said secondary skip to a first fixed side wall portion of the primary skip.

8. The apparatus of claim 7 wherein said means for pivotally coupling includes:

hinge means.

9. The apparatus of claim 7 wherein said scraper means includes:

a pair of oppositely disposed side walls;

a telescopic rear wall which extends between said side walls; and actuator means for controllably adjusting the width of said scraper means rear wall.

10. The apparatus of claim 7 wherein said means for controlling the angle of inclination of said secondary skip comprises a hydraulic actuator.

11. The apparatus of claim 9 wherein said means for controlling the angle of inclination of said secondary skip comprises a hydraulic actuator.

12. The apparatus of claim 1 wherein the primary skip has an opening at the bottom thereof and includes a pair of oppositely disposed movable side wall portions which cooperate to define a feed funnel for the primary skip, the pivotal side wall portions of the primary skip being removable from the primary skip thereby permitting said secondary skip to be supported on said primary skip.

13. The apparatus of claim 1 wherein said secondary skip extends outwardly from the paving machine in a direction which is generally transverse to the path of motion of the paving machine at least on the side of said one end of said secondary skip, the length of said extension of said secondary skip being sufficient to position said one end approximately in alignment with the outwardly disposed end of the first extension of the main beam.

14. The apparatus of claim 12 wherein said secondary skip extends outwardly from the paving machine in a direction which is generally transverse to the path of motion of the paving machine at least on the side of said one end of said second skip, the length of said extension of said secondary skip being sufficient to position said one end approximately in alignment with the outwardly disposed end of the first extension of the main beam.

15. The apparatus of claim 14 wherein said scraper means includes:

a pair of oppositely disposed side walls;

a telescopic rear wall which extends between said side walls; and actuator means for controllably adjusting the width of said scraper means rear wall.

16. The apparatus of claim 15 wherein said means for controlling the angle of inclination of said secondary skip comprises a hydraulic actuator.

17. The apparatus of claim 16 wherein the primary skip includes fixed side wall portions and wherein said means supporting said secondary skip comprises:

means for pivotally coupling said secondary skip to a first fixed side wall portion of the primary skip.

18. The apparatus of claim 17 wherein said means for pivotally coupling includes:

hinge means.

19. The apparatus of claim 18 wherein the paving machine includes a second distribution beam extension which is located at an opposite end of the main beam from the first beam extension, the length of said beam extensions being separately controllable by fluidic actuators, the second of the beam extensions being immobilized during use of said secondary skip, and wherein said actuator means of said scraper means comprises:

a further fluidic actuator, said further fluidic actuator being coupled to and deriving operating power from the actuator of the immobilized second beam extension.

20. The apparatus of claim 19 wherein said secondary skip extends outwardly from the paving machine substantially the same distance on each side thereof.

* * * * *